US010363737B2

(12) United States Patent
Kanegae et al.

(10) Patent No.: US 10,363,737 B2
(45) Date of Patent: Jul. 30, 2019

(54) LIQUID EJECTING HEAD WITH CONNECTION MECHANISM FOR A FLEXIBLE CIRCUIT AND CIRCUIT BOARD

(71) Applicant: SEIKO EPSON CORPORATION, Tokyo (JP)

(72) Inventors: Takahiro Kanegae, Shiojiri (JP); Katsuhiro Okubo, Azumino (JP); Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/807,781

(22) Filed: Nov. 9, 2017

(65) Prior Publication Data

US 2018/0134035 A1 May 17, 2018

(30) Foreign Application Priority Data

Nov. 11, 2016 (JP) ..... 2016-220459

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/14233* (2013.01); *B41J 2002/14241* (2013.01); *B41J 2002/14419* (2013.01); *B41J 2202/19* (2013.01); *B41J 2202/20* (2013.01)

(58) Field of Classification Search
CPC . B41J 2/04541; B41J 2/26; B41J 2/265; B41J 2/14233; B41J 2/04581; B41J 2202/20; B41J 2202/19; B41J 2002/14419; B41J 2002/14241
See application file for complete search history.

(56) References Cited

U.S. PATENT DOCUMENTS

2008/0165224 A1 7/2008 Akahane
2015/0273827 A1* 10/2015 Kondo ..... B41J 2/1433 347/50

FOREIGN PATENT DOCUMENTS

JP 2008-100400 A 5/2008

* cited by examiner

*Primary Examiner* — Henok D Legesse
(74) *Attorney, Agent, or Firm* — Workman Nydegger

(57) ABSTRACT

A liquid ejecting head includes a pair of connectors that can be connected to each other, a flexible circuit on which one of the connectors is mounted, a circuit board on which another one of the connectors is mounted, a driver element that generates a driving force for ejecting liquid from a nozzle in response to an electric signal that is supplied from the flexible circuit to the circuit board via the pair of connectors, and a locking mechanism that locks connection between the connector of the circuit board and the connector of the flexible circuit.

20 Claims, 7 Drawing Sheets

LIQUID EJECTING HEAD WITH CONNECTION MECHANISM FOR A FLEXIBLE CIRCUIT AND CIRCUIT BOARD

BACKGROUND

1. Technical Field

The present invention relates to a technique of ejecting a liquid such as ink.

2. Related Art

In a liquid ejecting head that ejects liquid, such as ink, onto a medium, such as a sheet of paper, from a plurality of nozzles by activating driver elements, electric power for activating the driver elements is supplied from a flexible circuit, such as a flexible flat cable. For example, JP-A-2008-100400 discloses a technique in which a connector (a wire connection portion) of a circuit board is disposed on a side wall of a liquid ejecting head and a flexible circuit is mounted by plugging the flexible circuit sideways into the connector.

However, in the case of disposing the connector of the circuit board on the side wall of the liquid ejecting head as disclosed in the JP-A-2008-100400, space for attaching/detaching the flexible circuit also needs to be provided on the side of the liquid ejecting head. This imposes restraints on the arrangement of the liquid ejecting head, for example, making it difficult to arrange a plurality of liquid ejecting heads densely in a matrix. On the other hand, reducing the space for attaching/detaching the flexible circuit increases the difficulty of mounting the flexible circuit. As a result, for example, the flexible circuit may be inserted obliquely into the connector, leading to a faulty connection or a failure to find a faulty connection.

SUMMARY

An advantage of some aspects of the invention is that a flexible circuit can be made to be securely connected to a connector of a circuit board.

A liquid ejecting head according an aspect of the invention includes a pair of connectors that can be connected to each other, a flexible circuit on which one of the connectors is mounted, a circuit board on which another one of the connectors is mounted, a driver element that generates a driving force for ejecting liquid from a nozzle in response to an electric signal that is supplied from the flexible circuit to the circuit board via the pair of connectors, and a locking mechanism that locks connection between the connector of the circuit board and the connector of the flexible circuit. In accordance with this configuration, the liquid ejecting head includes the locking mechanism that locks the connection in the state in which the connector of the circuit board and the connector of the flexible circuit are connected to each other. Thus, the locking of the locking mechanism indicates that the connection between the connectors are stably achieved. As a result, a faulty connection can be found more easily when compared to the case having no locking mechanism. Thus, in accordance with this configuration, the flexible circuit can be made to be securely connected to the connector of the circuit board.

It is preferable that in the liquid ejecting head, the one of the connectors have a protrusion protruding in a direction orthogonally intersecting a width direction of the flexible circuit, and that the other one of the connectors have a guide groove into which the protrusion is to be inserted. In accordance with this configuration, when the connectors are connected to each other, the protrusion of the one of the connectors is inserted into the guide groove of the other one of the connectors. Thus, the connection between the connectors can be achieved with the guidance of the protrusion and the guide groove. Thus, the flexible circuit can be connected without being inclined, which can reduce the likelihood of a faulty connection.

It is preferable that the liquid ejecting head further include a plurality of the pairs of connectors that can be connected to each other, and that when two of a plurality of the connectors of the flexible circuit are disposed at overlapped positions when viewed in a thickness direction of the flexible circuit and the two of the plurality of the connectors of the flexible circuit are designated as a first connector and a second connector, the locking mechanism of the first connector and the locking mechanism of the second connector be disposed on respective surfaces of the first connector and the second connector, the respective surfaces being opposite to surfaces of the first connector and the second connector that oppose each other in the thickness direction of the flexible circuit. In accordance with this configuration, the locking mechanism of the first connector and the locking mechanism of the second connector are disposed such that the two locking mechanisms face outward in directions opposite each other. This makes it easier to operate the locking mechanisms and to attach/detach the flexible circuits as compared with the case that two locking mechanisms are disposed so as to face each other.

It is preferable that the liquid ejecting head with this configuration include a liquid introduction device that introduces the liquid, and that the connector of the circuit board be disposed side by side with the liquid introduction device. In accordance with this configuration, the connector of the circuit board and the liquid introduction device can be arranged side by side on the same side surface of the liquid ejecting head. Thus, even in the case that instead of providing only one liquid ejecting head, for example, a plurality of the liquid ejecting heads are provided, the liquid ejecting heads can be arranged such that the liquid introduction devices and the connectors are disposed on the same side surfaces of the liquid ejecting heads. This arrangement can improve efficiency in connection operation for connecting piping to the liquid introduction devices as well as for connecting the connectors of the flexible circuits.

It is preferable that the liquid ejecting head further include a plurality of the liquid introduction devices and a plurality of the connectors of the circuit board, and that the plurality of the liquid introduction devices be arranged alternately with the plurality of the connectors of the circuit board in a width direction of the connectors of the circuit board. In accordance with this configuration, the plurality of the liquid introduction devices are arranged in the width direction of the connectors of the circuit board. Thus, the size of the liquid ejecting head can be reduced in the direction orthogonally intersecting the width direction.

It is preferable that in the liquid ejecting head, the circuit board include a plurality of the connectors of the circuit board, and that the circuit board be disposed in a direction orthogonally intersecting a nozzle plate in which the nozzle is disposed. In accordance with this configuration, the circuit board includes a plurality of the connectors of the circuit board, and the circuit board is disposed in a direction orthogonally intersecting a nozzle plate in which the nozzle is disposed. Thus, the size of the liquid ejecting head can be reduced in the thickness direction of the circuit board.

It is preferable that the liquid ejecting head further includes a cover that covers the circuit board in a state in which the locking mechanism is exposed. In accordance with this configuration, the circuit board can be covered with the cover while the locking mechanism is exposed therethrough. The locking mechanism can be operated conveniently while the cover efficiently prevents dust or the like from depositing on the circuit board.

It is preferable that in the liquid ejecting head with this configuration, the cover have an opening through which the connector of the circuit board is exposed, that the cover have a cutout portion formed in a wall surrounding the opening by lowering a height of a portion of the wall, and that the locking mechanism be exposed through the cutout portion. In accordance with this configuration, the cover has the cutout portion formed in the wall surrounding the opening by lowering the height of a portion of the wall, and the locking mechanism is exposed through the cutout portion. Thus, the wall still remains in the portion having the cutout portion. As a result, liquid can be restrained from entering the opening.

BRIEF DESCRIPTION OF THE DRAWINGS

The invention will be described with reference to the accompanying drawings, wherein like numbers reference like elements.

DESCRIPTION OF EXEMPLARY EMBODIMENTS

Liquid Ejecting Apparatus

Figure 1:
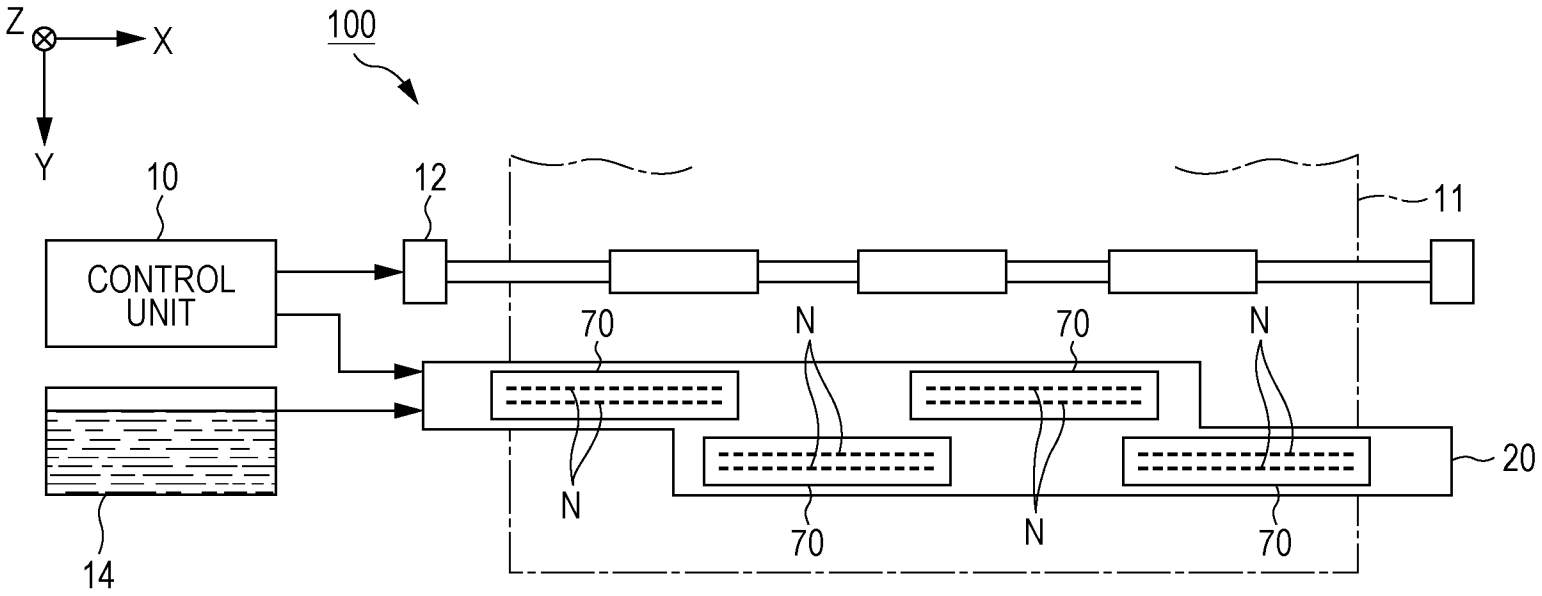
FIG. 1 is a diagram for illustrating a schematic structure of a liquid ejecting apparatus according to one embodiment of the invention.

FIG. 1 is a diagram illustrating a partial schematic structure of a liquid ejecting apparatus 100 according to one embodiment of the invention. The liquid ejecting apparatus 100 according to the present embodiment is a printing apparatus of an ink jet type that ejects ink, which is an example of a liquid, onto a medium 11, such as a sheet of paper for printing. The liquid ejecting apparatus 100 includes a control unit 10, a transport mechanism 12, a liquid container 14, and a liquid ejecting head 20.

The liquid container 14 is an ink tank type cartridge formed of a box-shaped container that is detachably installed in the body of the liquid ejecting apparatus 100. The liquid container 14 is not limited to the box-shaped container and may be an ink pack type cartridge formed of a bag-type container. The liquid container 14 contains ink. The ink may be a black ink or a color ink. The ink contained in the liquid container 14 is delivered under pressure to the liquid ejecting head 20 by a pump (not shown).

The control unit 10 controls each element of the liquid ejecting apparatus 100 in an integrated manner. The transport mechanism 12 transports a medium 11 in a Y direction under the control of the control unit 10. However, the structure of the transport mechanism 12 is not limited to this example. The liquid ejecting head 20 ejects ink that is supplied from the liquid container 14 onto the medium 11 under the control of the control unit 10. The liquid ejecting head 20 according to the embodiment is a line head in which a plurality of liquid ejecting devices 70 are arranged in the X direction that orthogonally intersects the Y direction, that is, the transport direction of the medium 11. Note that a direction that is perpendicular to an X-Y plane (i.e., a plane parallel to the surface of the medium 11) is hereinafter referred to as the "Z direction". The Z direction corresponds to the direction in which the liquid ejecting head 20 ejects ink.

FIG. 1 illustrates an example in which two liquid ejecting devices 70 are disposed in each of two rows. More specifically, four liquid ejecting devices 70 are arranged in a staggered manner in which a first row having two liquid ejecting devices 70 and a second row having two liquid ejecting devices 70 are arranged such that each of the liquid ejecting devices 70 takes a different position in the X direction. Note that the arrangement of a plurality of the liquid ejecting devices 70 are not limited to the arrangement illustrated in FIG. 1, but may be such that the liquid ejecting devices 70 are arranged side by side in the Y direction.

Liquid Ejecting Head

Figure 2:
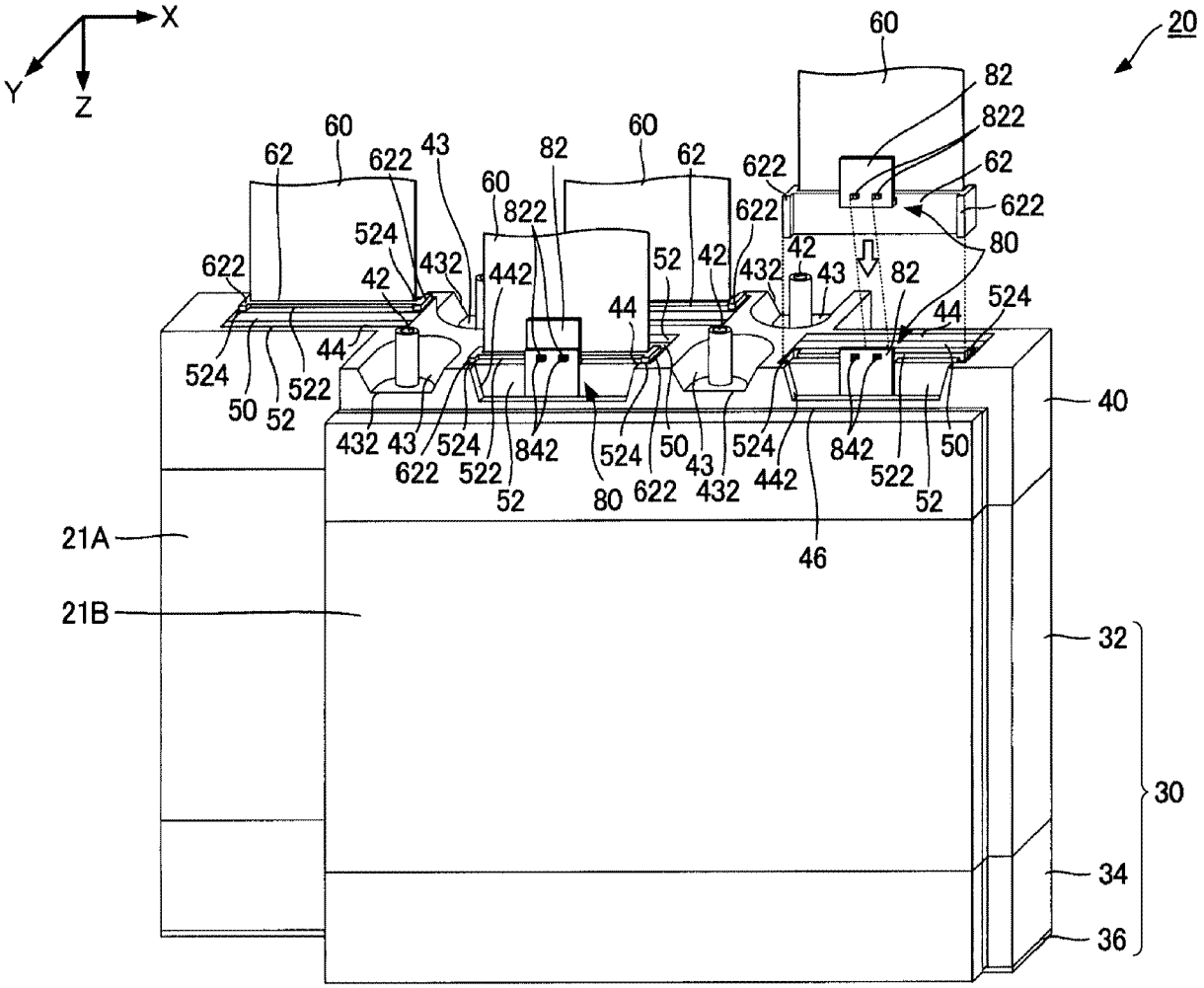
FIG. 2 is a perspective view illustrating an external appearance of a liquid ejecting head.
Figure 3:
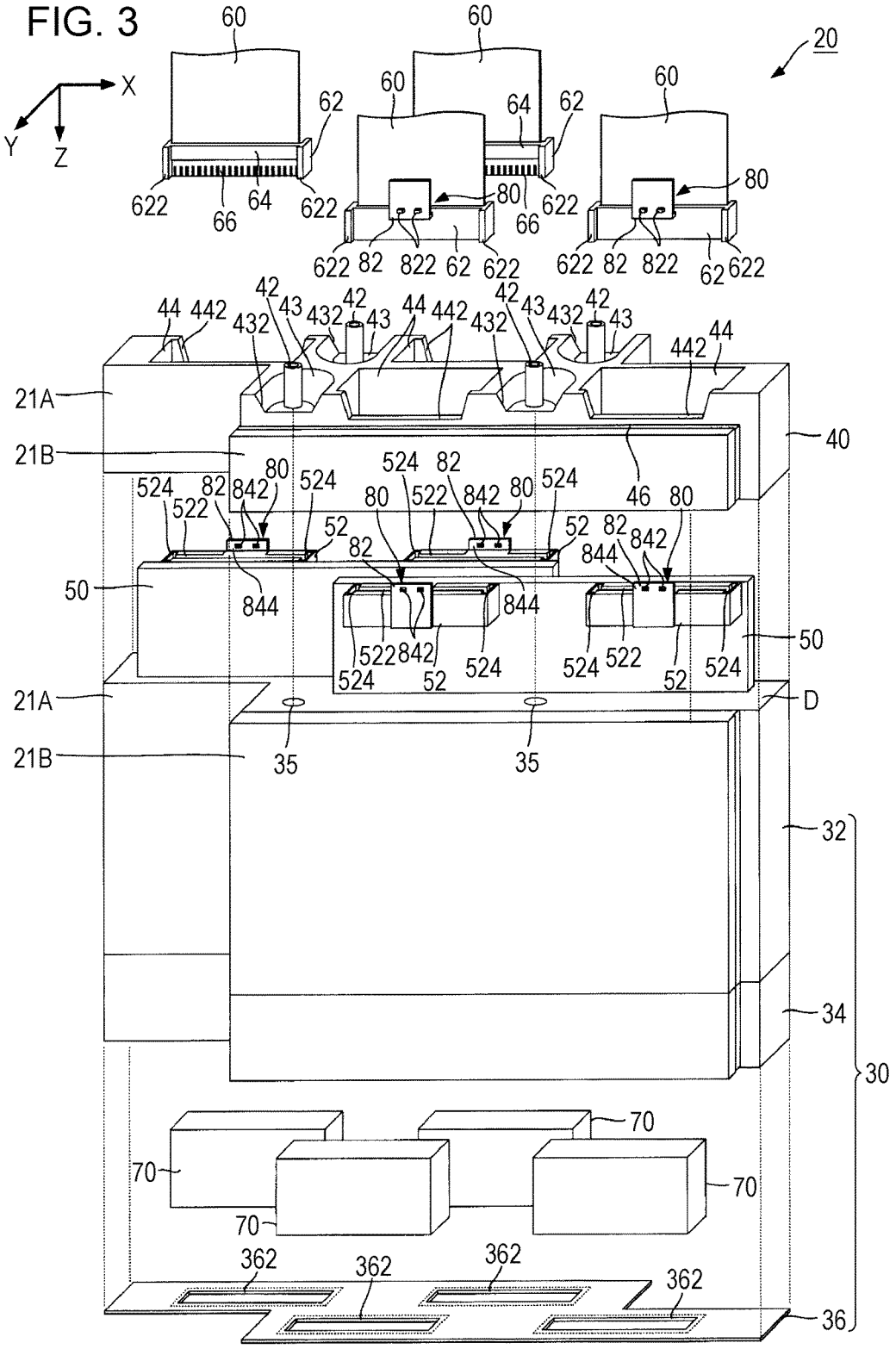
FIG. 3 is an exploded perspective view illustrating the liquid ejecting head.

FIG. 2 is a perspective view illustrating an external appearance of the liquid ejecting head 20 to show the structure thereof, and FIG. 3 is an exploded perspective view illustrating the liquid ejecting head 20. As illustrated in FIGS. 2 and 3, the liquid ejecting head 20 is formed so as to have two structural units 21A, 21B that are disposed together, with the two structural units 21A, 21B being shifted from each other in the X direction. Each of the structural units 21A, 21B is shaped as a box that extends longer in the X and Z directions than in the Y direction. The structural unit 21A includes the two liquid ejecting devices 70 of the first row, and the structural unit 21B includes the two liquid ejecting devices 70 of the second row.

The liquid ejecting head 20 includes a head body 30 and a cover 40. In the embodiment, for example, the head body 30 of the structural unit 21A and the head body 30 of the structural unit 21B are formed into a single unit, and the cover 40 of the structural unit 21A and the cover 40 of the structural unit 21B are also formed into a single unit. However, the head body 30 and the cover 40 each may be formed into separate units. The cover 40 is made, for example, of resin and is mounted on the upper side D (the side in the −Z direction) of the head body 30. The head body 30 includes the four liquid ejecting devices 70 described above, a first casing 32 and a second casing 34, a fixing plate 36, and two circuit boards 50. The first casing 32 is made of resin, while the second casing 34 is made of metal. However, the second casing 34 may be made of resin.

Each of the structural units 21A, 21B has one circuit board 50. The circuit board 50 is a board that extends in the X direction, which is the width direction, and in the Z direction. The circuit board 50 also has a thickness in the Y direction, and the size of the circuit board 50 in the Y direction is smaller than each of ones in the X and Z directions. The circuit board 50 includes components, such as a circuit for supplying drive signals to drive piezoelectric elements 732, which will be described below.

Each of the two circuit boards 50 according to the embodiment is fixed to the head body 30 so that each of the two circuit boards 50 stands erect in the Z direction. In other words, each circuit board 50 is disposed in a direction that orthogonally intersects a nozzle plate 74 (or the fixing plate 36) in which nozzles N are disposed (which will be described below). The four liquid ejecting devices 70 are fixed to the fixing plate 36 by using an adhesive and are accommodated in the second casing 34. The first casing 32 contains a plurality of flow path members (not shown) in which ink flow paths are formed. The flow path members include flow path open/close valves, pressure regulator valves, and filters.

A plurality of liquid introduction devices (ink introduction styluses) 42 that receive ink sent from the liquid container 14 are formed in the cover 40. In the embodiment, for example, four liquid introduction devices 42 are formed on the upper side of the cover 40. However, the number of the liquid introduction devices 42 is not limited to four. Piping (not shown) connected to the liquid container 14 is connected to the liquid introduction devices 42. In the embodiment, two of the four liquid introduction devices 42 are disposed in each of the structural units 21A, 21B. When the cover 40 is mounted on the head body 30, the four liquid introduction devices 42 are connected to four respective flow ports 35 that are formed on the upper side D of the head body 30 (the upper side of the first casing 32). The ink introduced by the four liquid introduction devices 42 is supplied to the four liquid ejecting devices 70 via flow paths (not shown) of a plurality of the flow path members.

The fixing plate 36 is a flat plate member that supports the liquid ejecting devices 70 and is made, for example, of a metal having high rigidity, such as stainless steel. As illustrated in FIG. 3, four openings 362 that correspond to respective liquid ejecting devices 70 are formed in the fixing plate 36. Each of the openings 362 is a through hole shaped substantially as a rectangle having longer sides in the X direction when viewed in the Z direction.

Figure 4:
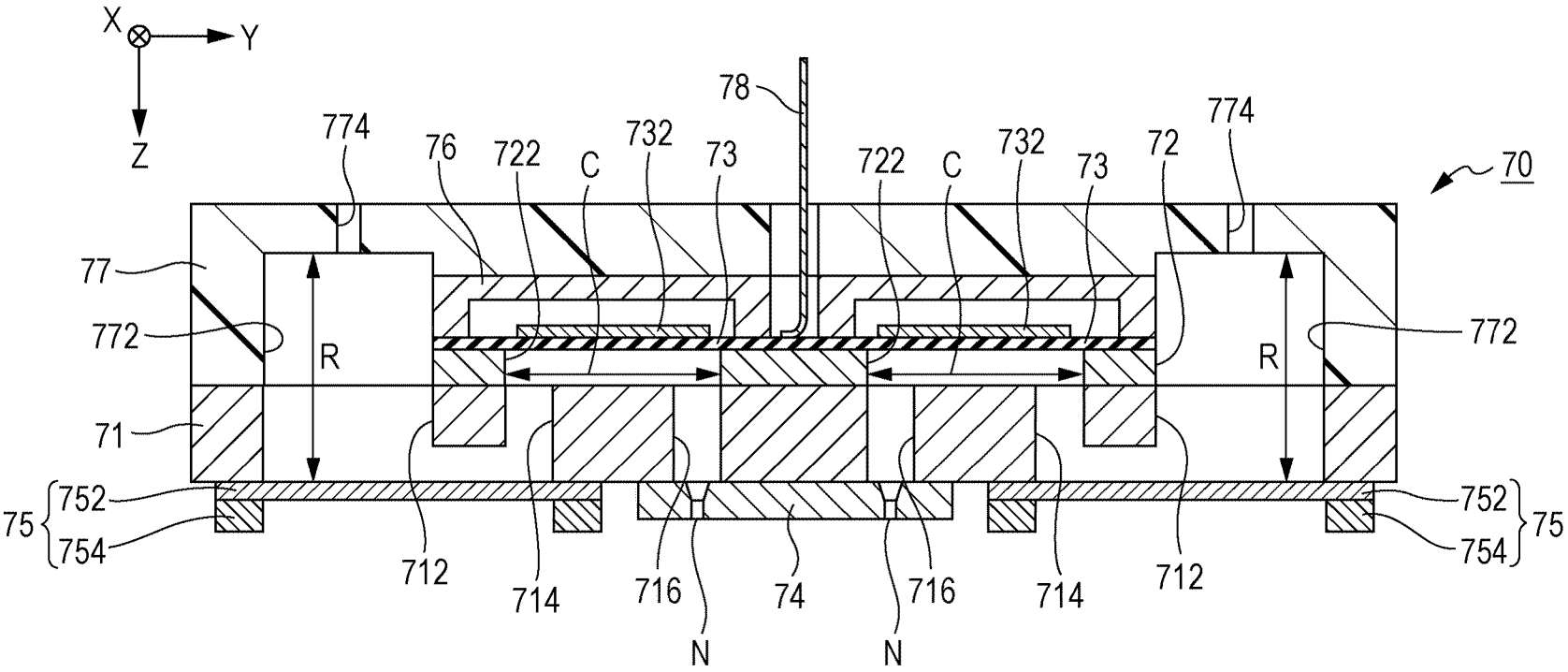
FIG. 4 is a cross-sectional view illustrating a liquid ejecting device.

FIG. 4 is a cross-sectional view illustrating any one of the liquid ejecting devices 70. As illustrated in FIG. 4, the liquid ejecting device 70 according to the embodiment includes a head chip in which a pressure chamber-formed substrate 72 and a vibrating plate 73 are layered on one surface of a flow path-formed substrate 71 while the nozzle plate 74 and a compliant portion 75 are provided on the other surface. A plurality of nozzles N are formed in the nozzle plate 74. In one liquid ejecting device 70, structures corresponding to respective rows of the nozzles N are formed with linear symmetry. Thus, the structure of the liquid ejecting device 70 will be described below while focusing on one row of the nozzles N for clarity. Four nozzle plates 74 are exposed from the four respective openings 362.

The flow path-formed substrate 71 is a flat plate material in which flow paths of ink are formed. In the flow path-formed substrate 71 according to the embodiment, an opening 712, a supply flow path 714, and a communicating flow path 716 are formed. The supply flow path 714 and the communicating flow path 716 are formed for each of the nozzles N, and the opening 712 is formed to extend continuously for a plurality of the nozzles N. The pressure chamber-formed substrate 72 is a flat plate material in which a plurality of openings 722 that correspond to respective nozzles N are formed. The flow path-formed substrate 71 or the pressure chamber-formed substrate 72 is formed, for example, of a substrate of single-crystal silicon.

The compliant portion 75 illustrated in FIG. 4 is a mechanism for reducing (or absorbing) pressure fluctuations within flow paths in the liquid ejecting device 70. The compliant portion 75 includes a sealing membrane 752 and a support 754 formed therein. The sealing membrane 752 is a film-shaped member having flexibility, and the support 754 fixes the sealing membrane 752 to the flow path-formed substrate 71 so as to seal the opening 712 and each supply flow path 714 of the flow path-formed substrate 71.

As illustrated in FIG. 4, a vibrating plate 73 is provided on the side surface of the pressure chamber-formed substrate 72 opposite to the flow path-formed substrate 71. The vibrating plate 73 is a member shaped as a flat plate that can elastically vibrate and is constituted, for example, by layers of an elastic membrane formed of an elastic material, such as silicon oxide, and of an insulation membrane formed of an insulation material, such as zirconium oxide. The vibrating plate 73 and the flow path-formed substrate 71 oppose each other with a space therebetween inside each of the openings 722 that are formed in the pressure chamber-formed substrate 72. The space inside each of the openings 722 that is formed between the flow path-formed substrate 71 and the vibrating plate 73 functions as a pressure chamber (or cavity) C that applies pressure to ink. A plurality of the pressure chambers C are arranged in the X direction.

A plurality of piezoelectric elements 732 that correspond to respective nozzles N are formed on the side surface of the vibrating plate 73 opposite to the pressure chamber-formed substrate 72. Each of the piezoelectric elements 732 is a layered product in which a piezoelectric substance is sandwiched between electrodes that oppose each other. By supplying a drive signal, a piezoelectric element 732 vibrates together with the vibrating plate 73, which causes a change in the pressure in the pressure chamber C, and thereby the ink in the pressure chamber C is ejected from a nozzle N. Thus, the piezoelectric element 732 functions as a driver element that generates a driving force for ejecting ink from the nozzle N. Each piezoelectric element 732 is sealed and protected by a protection plate 76 that is fixed to the vibrating plate 73.

As illustrated in FIG. 4, a support body 77 is fixed to the flow path-formed substrate 71 and to the protection plate 76. The support body 77 is formed as a single piece by molding a resin material. In the support body 77 according to the embodiment, a space 772 and a supply port 774 are formed. The space 772 and the opening 712 of the flow path-formed substrate 71 form a liquid storage chamber (reservoir) R, and the supply port 774 is in communication with the liquid storage chamber R. The liquid storage chamber R stores ink that is introduced from each of the liquid introduction devices 42. The ink stored in the liquid storage chamber R is distributed through a plurality of supply flow paths 714 and filled into the pressure chambers C. From each of the pressure chambers C, the ink passes through the communicating flow path 716 and the nozzle N and is ejected therefrom (toward the medium 11).

An end of an individual circuit board 78 is joined to the vibrating plate 73. The individual circuit board 78 is a flexible circuit board containing a circuit for transmitting drive signals or a power supply voltage to each piezoelectric element 732. Two individual circuit boards 78 for the respective liquid ejecting devices 70 are connected to each of the two circuit boards 50.

Structure of Connectors for Connecting Flexible Circuit

As illustrated in FIG. 3, the two circuit boards 50 are fixed inside the first casing 32 of the head body 30. Each of the two circuit boards 50 protrudes upward through the upper side D of the head body 30 (i.e., the upper side of the first casing 32). In each of the two circuit boards 50, two connectors 52 are mounted on the portions of the circuit board 50 that protrude above the upper side D of the head body 30. Thus, the two circuit boards 50 have a total of four connectors 52. As illustrated in FIG. 3, four openings 44 are formed in the cover 40. As illustrated in FIG. 2, when the cover 40 is mounted on the head body 30, one of the four connectors 52 is exposed from a corresponding one of the four openings 44. As described above, a plurality of the connectors 52 are provided for each of the circuit boards 50, and the circuit boards 50 are installed vertically in a direction orthogonally intersecting the nozzle plate 74. Thus, the size of the liquid ejecting head 20 can be reduced in the thickness direction of the circuit board 50.

A flexible circuit 60 is connected to each of the four connectors 52. More specifically, a connector 62 is detachably mounted at the end of a flexible circuit 60, and the flexible circuit 60 is connected to a connector 52 of the circuit board 50 via the connector 62. The connector 52 and the connector 62 function as a pair of connectors that can be connected to each other. In response to an electric signal that is supplied to the circuit board 50 from the flexible circuit 60 via a pair of the connectors 52 and 62, a piezoelectric element 732 generates a driving force for ejecting ink from a nozzle N.

More specifically, the control unit 10 supplies an electric signal to the circuit board 50 via the flexible circuit 60. In response to the electric signal, a driver circuit (not shown) on the circuit board 50 generates a drive signal for the piezoelectric element 732, and the drive signal is supplied to the piezoelectric element 732 via the individual circuit board 78 of a liquid ejecting device 70. Thus, the piezoelectric element 732 generates the driving force for ejecting ink from the nozzle N.

The flexible circuit 60 is a circuit board that has flexibility and a width in the X direction. One or a plurality of wires for an electric signal are formed on the surface of the circuit board. For example, a flexible flat cable (FFC) or a flexible printed circuit (FPC) can be utilized preferably as the flexible circuit 60. As illustrated in FIG. 3, the connector 62 is a member that is made of resin and substantially shaped as a plate. The connector 62 has a width (width in the X direction) slightly larger than that of the flexible circuit 60 and is formed such that the flexible circuit 60 can be mounted on one surface of the connector 62.

The connector 62 has protrusions 622 formed at both ends in the width direction. Each of the protrusions 622 protrudes in a direction (i.e., Y direction) that orthogonally intersects the width direction (i.e., X direction) of the flexible circuit 60. Thus, the cross-section of the connector 62 on an X-Y plane is shaped substantially as the letter "H". Each of the protrusions 622 protrudes from one surface of the connector 62 and also from the other surface of the connector 62 and is continuous in the Z direction. However, the protrusions 622 may not be continuous in the Z direction.

On the other hand, each of the connectors 52 of circuit boards 50 has an insertion hole 522 into which a connector 62 is inserted. The cross-section of the insertion hole 522 on an X-Y plane is shaped substantially as the letter "H", which is substantially similar to the cross-section of the connector 62. More specifically, the insertion hole 522 extends in the width direction (i.e., the X direction) and has guide grooves 524 formed at both ends in the width direction. The protrusions 622 are inserted into the guide grooves 524. Each of the guide grooves 524 extends in the Y direction and is continuous in the Z direction. The guide grooves 524 guide the insertion of the protrusions 622.

With the connectors 52 and 62 having such configurations, when the connectors 52 and 62 are connected to each other, the protrusions 622 of the connector 62 are inserted into the guide grooves 524 of the connectors 52 so that the connection between the connectors 52 and 62 can be achieved with the guidance of the protrusions 622 and the guide grooves 524. Thus, the flexible circuit can be connected without being inclined, which can reduce the likelihood of a faulty connection.

Note that the cross-sectional shape of the connector 62 on the X-Y plane is not limited to the shape exemplified in the embodiment. In the embodiment, the case of the protrusions 622 being formed at both ends of the connector 62 in the width direction has been described by way of example. However, the protrusion 622 may be provided at only one end of the connector 62 in the width direction.

Figure 5:
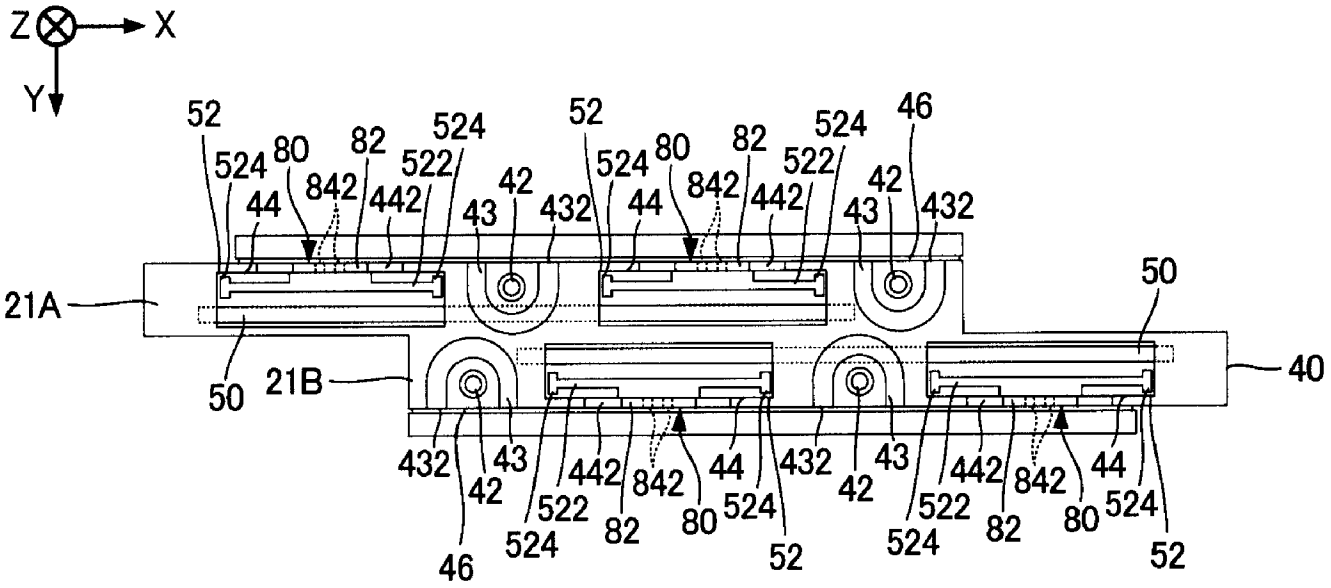
FIG. 5 is a plan view of a cover mounted on a head body when viewed from above.

FIG. 5 is a plan view of the cover 40 mounted on the head body 30 when viewed from above (viewed from the side in the +Z direction). As illustrated in FIG. 5, in each of the structural units 21A, 21B, the openings 44, in which respective connectors 52 are exposed, and the liquid introduction devices 42 are arranged side by side on the upper side (the side in the −Z direction) of the cover 40. In accordance with this arrangement, the connectors 52 and the liquid introduction devices 42 are disposed side by side on the same side (i.e., the upper side of the cover 40). This makes it easier to connect the piping to the liquid introduction devices 42 as well as to connect the connectors 62 of the flexible circuits 60 to the connectors 52, compared with the case in which the connectors 52 and the liquid introduction devices 42 are disposed on different sides.

For example, if a plurality of the liquid ejecting heads 20 are provided, the liquid ejecting heads 20 can be arranged such that the liquid introduction devices 42 and the connectors 52 are arranged on the same sides of the liquid ejecting heads 20. This can improve the efficiency of the connecting operation for connecting the piping to the liquid introduction devices 42 and connecting the connectors 62 of the flexible circuits 60 to the connectors 52. In addition, the connectors 52 are arranged alternately with a plurality of the liquid introduction devices 42 in the width direction of the connectors 52. In this case, the size of the liquid ejecting head 20 can be reduced in the direction (i.e., Y direction) orthogonally intersecting the width direction of the connectors 52.

Locking Mechanism of Connectors

Figure 6:
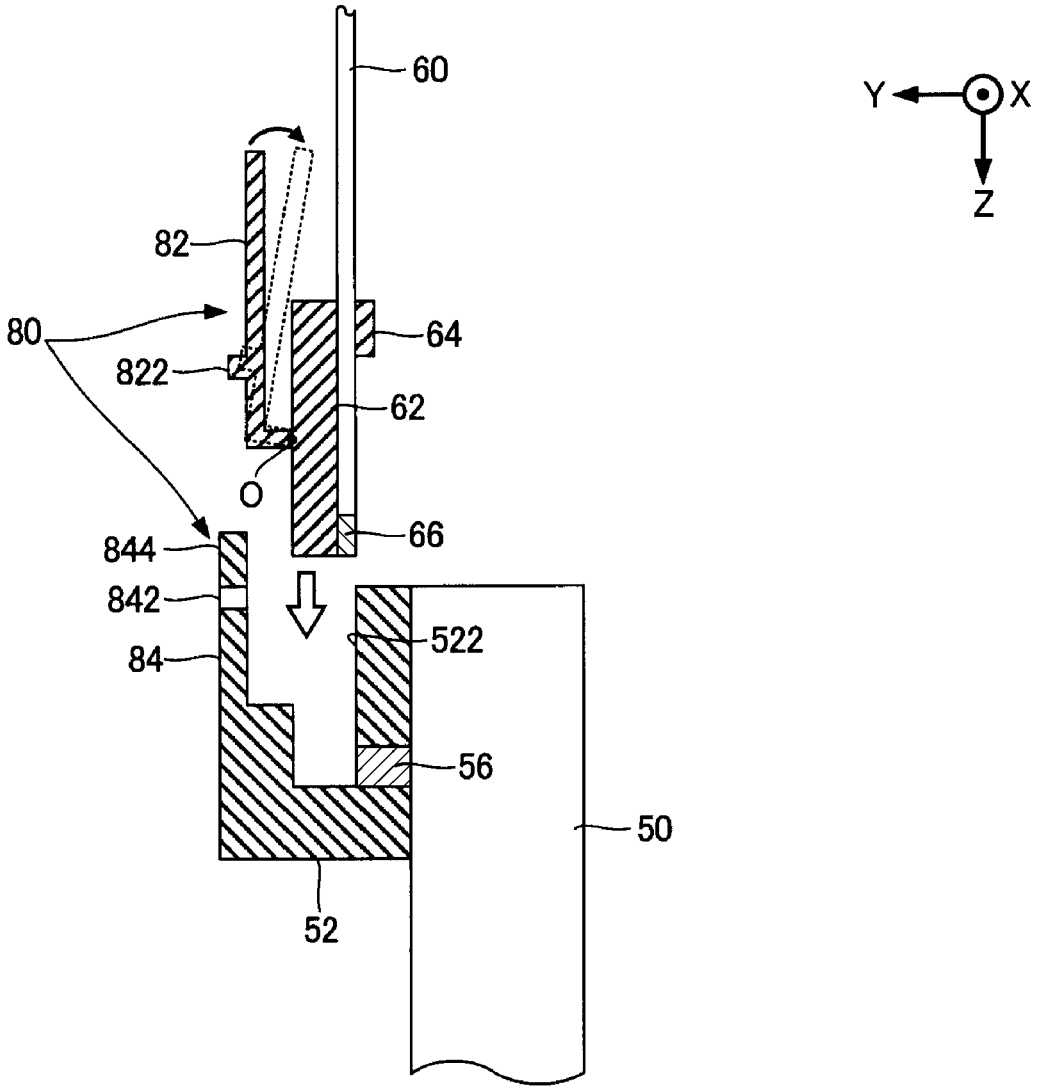
FIG. 6 is a cross-sectional view illustrating a state before connectors are connected to each other.
Figure 7:
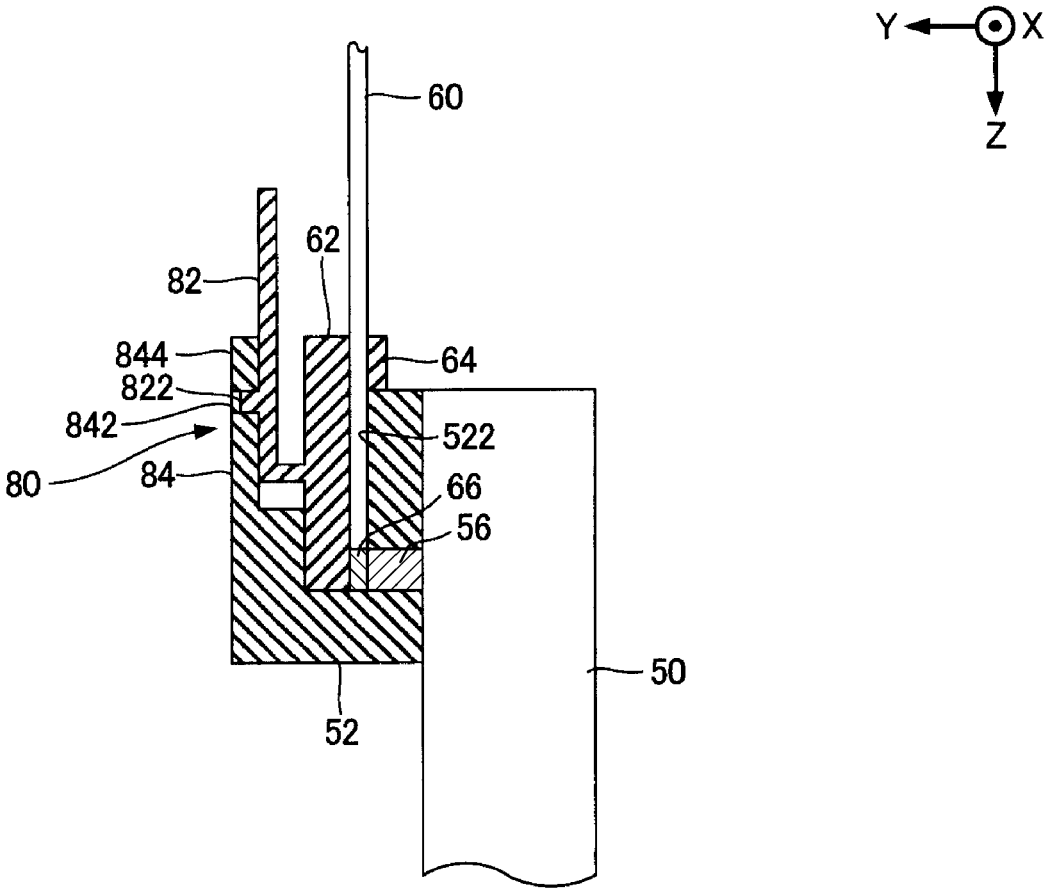
FIG. 7 is a cross-sectional view illustrating a state after the connectors are connected to each other.

FIG. 6 is a cross-sectional view illustrating the state before a connector 52 and a connector 62 of the structural unit 21B are connected to each other. FIG. 7 is a cross-sectional view illustrating the state after the connector 52 and the connector 62 of the structural unit 21B are connected to each other. As illustrated in FIGS. 2 and 6, the connector 52 and the connector 62 each include a locking mechanism 80 that causes the connection between the connector 52 and the connector 62 to enter a lock state or an unlock state. The locking mechanism 80 locks the connection while the connector 52 of the circuit board 50 and the connector 62 of the flexible circuit 60 are connected to each other.

More specifically, the locking mechanism 80 is constituted by a lever portion 82 disposed in the connector 62 of the flexible circuit 60 and a receiving portion 84 disposed in the connector 52 of the circuit board 50. As illustrated in FIGS. 3 and 6, the connector 62 has two sides (sides in the Y direction) that are parallel to each other. The lever portion 82 is disposed on one of the two sides of the connector 62, and the flexible circuit 60 is fixed by a fixing plate 64 to the other side (i.e., the side of the connector 62 opposite to the side having the lever portion 82). The fixing plate 64 is a member that is substantially shaped as a plate and extends in the width direction of the flexible circuit 60. The fixing plate 64 fixes the flexible circuit 60 to the connector 62 so as to press the flexible circuit 60 against the other side of the connector 62.

As illustrated in FIG. 6, the lever portion 82 is a plate-shaped member that has a cross-section on the Y-Z plane substantially shaped as the letter "L" and that has a free top end and a bottom end that is bent and fixed to the connector 62. The lever portion 82 can swing on a Y-Z plane about a portion O that is fixed to the connector 62. The lever portion 82 has lugs 822 protruding from the outside surface of the lever portion 82.

As illustrated in FIG. 7, the receiving portion 84 is disposed such that when the connectors 52 and 62 are connected to each other, the receiving portion 84 comes to a position opposing the lever portion 82. The connector 52 has two sides (sides in the Y direction) that are parallel to each other. The receiving portion 84 is disposed on one of the two sides. The receiving portion 84 has through holes 842 into which the lugs 822 of the lever portion 82 can be inserted. The connection between the connectors 52 and 62 enters the lock state by inserting the lugs 822 of the lever portion 82 into the through holes 842.

The number of lugs 822 and the number of the through holes 842 may be one or more for each locking mechanism 80. In the embodiment, for example, two lugs 822 and two through holes 842 are provided. The receiving portion 84 has a projection 844 that is formed so as to project upward from the upper side of the connector 52. The connector 62 is inserted into the insertion hole 522 of the connector 52 while the projection 844 is guiding the lever portion 82.

With the locking mechanism 80 having the above configuration, when the connector 62 is connected to the connector 52, the connector 62 is inserted into the insertion hole 522 of the connector 52 while the lever portion 82 is bent with the portion O as the pivot, as indicated by the dotted line in FIG. 6. Consequently, as illustrated in FIG. 7, the lugs 822 are inserted into the through holes 842 in the state in which the connector 62 is connected to the connector 52, in other words, in the state in which an electric terminal 66 that is exposed at the bottom of the flexible circuit 60 is brought into contact with an electric terminal 56 of the circuit board 50 that is exposed within the insertion hole 522 of the connector 52. Thus, the connection enters the lock state.

On the other hand, when the connector 62 is removed from the connector 52, bending the lever portion 82 in the state illustrated in FIG. 7 causes the lugs 822 to dislodge from the through holes 842 and thereby releases the connection from the lock state. In this state, by pulling the connector 62 from the connector 52, the connector 62 can be removed from the connector 52.

Thus, in accordance with the embodiment, the locking mechanism 80 can lock the connection when the connector 52 of the circuit board 50 and the connector 62 of the flexible circuit 60 are connected to each other. In other words, the locking of the locking mechanism 80 indicates that the connection between the connectors 52 and 62 are stably achieved. Thus, a faulty connection can be found more easily when compared with the case having no locking mechanism 80. This helps the connector 62 of the flexible circuit 60 to be steadily inserted until the connector 62 is connected to the connector 52 of the circuit board 50 (i.e., until the locking mechanism 80 locks the connection). Thus, in accordance with the embodiment, the flexible circuit 60 can be made to be securely connected to the connector 52 of the circuit board 50.

In the case that a plurality of pairs of the connector 52 and the connector 62 that can be connected to each other are provided as in the embodiment, two of the connectors 62 of the flexible circuits 60 may be disposed at overlapped positions when viewed in a thickness direction (i.e., Y direction) of the flexible circuits 60. The two of the connectors 62 may be individually referred to as a first connector 62A and a second connector 62B. In FIG. 2, for example, when the right connector 62 of the structural unit 21A is taken as the first connector 62A, the left connector 62 of the structural unit 21B corresponds to the second connector 62B. In this case, the locking mechanism 80 of the first connector 62A and the locking mechanism 80 of the second connector 62B are disposed on respective outward-facing surfaces of the first connector 62A and the second connector 62B. The outward-facing surfaces are surfaces opposite to the surfaces of the first connector 62A and the second connector 62B that oppose each other in the thickness direction (i.e., Y direction) of the flexible circuits 60.

In accordance with this configuration, the locking mechanism 80 of the first connector 62A and the locking mechanism 80 of the second connector 62B are disposed such that the two locking mechanisms 80 face outward in opposite directions. This makes it easier to operate the locking mechanisms 80 and to attach/detach the flexible circuits 60 as compared with the case that two locking mechanisms 80 are disposed so as to face each other.

As illustrated in FIG. 2, a cutout portion 442 is formed in each of the openings 44 in the cover 40 by lowering the height of a portion of the walls surrounding each of the openings 44. The locking mechanism 80 is thereby exposed from the cutout portion 442. In the structural unit 21A, the cutout portions 442 are formed on the respective sides in the −Y direction of the openings 44, while in the structural unit 21B, the cutout portions 442 are formed on the respective sides in the +Y direction of the openings 44, which is opposite to the sides of the structural unit 21A. In accordance with this configuration, the circuit boards 50 can be covered with the cover 40 while the locking mechanisms 80 are exposed therethrough. The locking mechanisms 80 can be operated conveniently while the cover 40 efficiently prevents dust or the like from depositing on the circuit boards 50.

Note that in the embodiment, flow paths 46 are formed so as to drain ink dropping from the four liquid introduction devices 42. More specifically, as illustrated in FIGS. 2 and 5, a flow path 46 is formed in each of the structural units 21A, 21B so as to extend on the upper side of the cover 40 in a direction in which liquid introduction devices 42 are disposed. Recessed portions 43 are formed in the cover 40. The four liquid introduction devices 42 according to the embodiment stand upward from the respective bottoms of recessed portions 43. In a recessed portion 43, a cutout portion 432 is formed in a portion of a wall facing the flow path 46 of the cover 40 in the walls surrounding the recessed portion 43. In the recessed portions 43 of the structural unit 21A, the cutout portions 432 are formed on the respective sides in the −Y direction of the recessed portions 43, while in the recessed portions 43 of the structural unit 21B, the cutout portions 432 are formed on the respective sides in the +Y direction of the recessed portions 43, in other words, on the respective sides of the recessed portions 43 that are opposite to those of the structural unit 21A. The flow path 46 of the structural unit 21A is formed so as to extend in the X direction on the same side as the cutout portions 432 are formed, in other words, on the side of the structural unit 21A in the −Y direction. The flow path 46 of the structural unit 21B is formed so as to extend in the X direction on the same side as the cutout portions 432 are formed, in other words, on the side of the structural unit 21B in the +Y direction. Thus, ink dropping from the liquid introduction devices 42 flows from the cutout portions 432 of the recessed portions 43 into the flow paths 46, which can restrain ink from dropping down the sides in the −Y and +Y directions that may likely be touched by hand.

In the cover 40 according to the embodiment, as previously discussed with reference to FIG. 2, a cutout portion 442 is formed in each of the openings 44 in the cover 40 by lowering the height of a portion of the walls surrounding each of the openings 44. The locking mechanism 80 is thereby exposed from the cutout portion 442. Although the cutout portion 442 is provided on the side facing the flow path 46, remaining walls of the opening 44 can restrain the ink flowing in the flow path 46 from entering the opening 44.

Modification

Each of the exemplary embodiments described above can be modified in various ways. Some examples of modification will be described below. Any two or more configurations in the examples below can be appropriately combined unless it causes contradiction.

In the embodiment, the case that the insertion hole 522 is provided in the connector 52 of the circuit board 50 has been described by way of example. However, the insertion hole 522 may be provided in the connector 62 of the flexible circuit 60.

In the embodiment, the line head system in which the liquid ejecting head 20 is disposed over the whole width of the medium 11 has been described by way of example. However, the invention can be used for a serial head system in which a carriage with a liquid ejecting head 20 mounted thereon moves reciprocally in the X direction.

In the embodiment, the liquid ejecting head 20 of a piezoelectric type that uses piezoelectric elements for applying mechanical vibration to the pressure chamber has been described by way of example. However, the liquid ejecting head can be a thermal type head using heating elements for generating bubbles in the pressure chamber by heat.

The liquid ejecting apparatus exemplified in the embodiment can be adopted in various apparatuses, such as facsimiles or copiers, as well as apparatuses dedicated for printing. However, the liquid ejecting apparatus according to the invention is not limited to printing applications. For example, a liquid ejecting apparatus that ejects a coloring material solution can be used in a production system for forming color filters of liquid crystal displays. Moreover, a liquid ejecting apparatus that ejects a conductive material solution can be used in a production system for forming wiring of circuit boards or electrodes.

CROSS-REFERENCE TO RELATED APPLICATIONS

This application claims priority to Japanese Patent Application No. 2016-220459 filed on Nov. 11, 2016. The entire disclosures of Japanese Patent Application No. 2016-220459 are hereby incorporated herein by reference.

What is claimed is:

1. A liquid ejecting head comprising:

a pair of connectors configured to connect to each other;

a flexible circuit on which one of the connectors is mounted;

a circuit board on which another one of the connectors is mounted;

a driver element that generates a driving force for ejecting liquid from a nozzle in response to an electric signal that is supplied from the flexible circuit to the circuit board via the pair of connectors; and a locking mechanism that is configured to take (i) a first state in which connection between the flexible circuit and the circuit board is locked while the pair of connectors are connected, and (ii) a second state in which connection between the flexible circuit and the circuit board is not locked while the pair of connectors are connected.

2. The liquid ejecting head according to claim 1, wherein the one of the connectors has a protrusion protruding in a direction orthogonally intersecting a width direction of the flexible circuit, and the other one of the connectors has a guide groove into which the protrusion is to be inserted.

3. The liquid ejecting head according to claim 2, further comprising:

a plurality of the pairs of connectors configured to connect to each other, wherein when two of a plurality of the connectors of the flexible circuit are disposed at overlapped positions when viewed in a thickness direction of the flexible circuit and the two of the plurality of the connectors of the flexible circuit are designated as a first connector and a second connector, the locking mechanism of the first connector and the locking mechanism of the second connector are disposed on respective surfaces of the first connector and the second connector, the respective surfaces being opposite to surfaces of the first connector and the second connector that oppose each other in the thickness direction of the flexible circuit.

4. The liquid ejecting head according to claim 3, further comprising:

a liquid introduction device that introduces the liquid, wherein the connector of the circuit board is disposed side by side with the liquid introduction device.

5. The liquid ejecting head according to claim 4, further comprising:

a plurality of the liquid introduction devices and a plurality of the connectors of the circuit board, wherein the plurality of the liquid introduction devices are arranged alternately with the plurality of the connectors of the circuit board in a width direction of the connectors of the circuit board.

6. The liquid ejecting head according to claim 5, wherein the circuit board includes a plurality of the connectors of the circuit board, and the circuit board is disposed in a direction orthogonally intersecting a nozzle plate in which the nozzle is disposed.

7. The liquid ejecting head according to claim 6, further comprising:

a cover that covers the circuit board in a state in which the locking mechanism is exposed.

8. The liquid ejecting head according to claim 7, wherein the cover has an opening through which the connector of the circuit board is exposed, the cover has a cutout portion formed in a wall surrounding the opening by lowering a height of a portion of the wall, and the locking mechanism is exposed through the cutout portion.

9. The liquid ejecting head according to claim 2, further comprising:

a liquid introduction device that introduces the liquid, wherein the connector of the circuit board is disposed side by side with the liquid introduction device.

10. The liquid ejecting head according to claim 2, wherein the circuit board includes a plurality of the connectors of the circuit board, and the circuit board is disposed in a direction orthogonally intersecting a nozzle plate in which the nozzle is disposed.

11. The liquid ejecting head according to claim 2, further comprising:

a cover that covers the circuit board in a state in which the locking mechanism is exposed.

12. The liquid ejecting head according to claim 1, further comprising:

a plurality of the pairs of connectors configured to connect to each other, wherein when two of a plurality of the connectors of the flexible circuit are disposed at overlapped positions when viewed in a thickness direction of the flexible circuit and the two of the plurality of the connectors of the flexible circuit are designated as a first connector and a second connector, the locking mechanism of the first connector and the locking mechanism of the second connector are disposed on respective surfaces of the first connector and the second connector, the respective surfaces being opposite to surfaces of the first connector and the second connector that oppose each other in the thickness direction of the flexible circuit.

13. The liquid ejecting head according to claim 1, further comprising:

a liquid introduction device that introduces the liquid, wherein the connector of the circuit board is disposed side by side with the liquid introduction device.

14. The liquid ejecting head according to claim 13, further comprising:

a plurality of the liquid introduction devices and a plurality of the connectors of the circuit board, wherein the plurality of the liquid introduction devices are arranged alternately with the plurality of the connectors of the circuit board in a width direction of the connectors of the circuit board.

15. The liquid ejecting head according to claim 1, wherein the circuit board includes a plurality of the connectors of the circuit board, and the circuit board is disposed in a direction orthogonally intersecting a nozzle plate in which the nozzle is disposed.

16. The liquid ejecting head according to claim 1, further comprising:

a cover that covers the circuit board in a state in which the locking mechanism is exposed.

17. The liquid ejecting head according to claim 16, wherein the cover has an opening through which the connector of the circuit board is exposed, the cover has a cutout portion formed in a wall surrounding the opening by lowering a height of a portion of the wall, and the locking mechanism is exposed through the cutout portion.

18. The liquid ejecting head according to claim 1, wherein the locking mechanism shifts the first state to the second state by bending.

19. A liquid ejecting head comprising:

a pair of connectors configured to connect to each other;

a flexible circuit on which one of the connectors is mounted;

a circuit board on which another one of the connectors is mounted;

a driver element that generates a driving force for ejecting liquid from a nozzle in response to an electric signal that is supplied from the flexible circuit to the circuit board via the pair of connectors; and a locking mechanism that locks connection between the connector of the flexible circuit and the circuit board while the pair of connectors are connected, wherein the one of the connectors has a protrusion protruding in a direction orthogonally intersecting a width direction of the flexible circuit, and the other one of the connectors has a guide groove into which the protrusion is to be inserted.

20. A liquid ejecting head comprising:

a pair of connectors configured to connect to each other;

a flexible circuit on which one of the connectors is mounted;

a circuit board on which another one of the connectors is mounted;

a driver element that generates a driving force for ejecting liquid from a nozzle in response to an electric signal that is supplied from the flexible circuit to the circuit board via the pair of connectors; and a locking mechanism that locks connection between the connector of the flexible circuit and the circuit board while the pair of connectors are connected, a plurality of the pairs of connectors configured to connect to each other, when two of a plurality of the connectors of the flexible circuit are disposed at overlapped positions when viewed in a thickness direction of the flexible circuit and the two of the plurality of the connectors of the flexible circuit are designated as a first connector and a second connector, the locking mechanism of the first connector and the locking mechanism of the second connector are disposed on respective surfaces of the first connector and the second connector, the respective surfaces being opposite to surfaces of the first connector and the second connector that oppose each other in the thickness direction of the flexible circuit.

* * * * *